US010813820B1

(12) United States Patent
Buettgen

(10) Patent No.: US 10,813,820 B1
(45) Date of Patent: Oct. 27, 2020

(54) MORTUARY TRANSPORT VEHICLE TRAY

(71) Applicant: John J. Buettgen, Schofield, WI (US)

(72) Inventor: John J. Buettgen, Schofield, WI (US)

( * ) Notice: Subject to any disclaimer, the term of this patent is extended or adjusted under 35 U.S.C. 154(b) by 0 days.

(21) Appl. No.: 16/503,085

(22) Filed: Jul. 3, 2019

Related U.S. Application Data

(60) Provisional application No. 62/694,730, filed on Jul. 6, 2018.

(51) Int. Cl.
*A61G 21/00* (2006.01)
*A61G 1/02* (2006.01)
*A61G 3/08* (2006.01)

(52) U.S. Cl.
CPC ..... *A61G 21/00* (2013.01); *A61G 1/02* (2013.01); *A61G 3/0833* (2013.01)

(58) Field of Classification Search
CPC ..... A61G 21/00; A61G 1/02; A61G 3/0833; A61G 17/04; A61G 7/1046
USPC ..... 27/28, 27; 296/16–20; 280/640; 5/81.1 R, 86.1
See application file for complete search history.

(56) References Cited

U.S. PATENT DOCUMENTS 1,517,069 A 11/1924 Huddart
1,702,010 A * 2/1929 Klever ..... A61G 7/0507 296/20
2,142,215 A 1/1939 Schmidt
2,303,618 A * 12/1942 Couleur ..... A61G 1/0237 296/19
2,747,919 A * 5/1956 Ferneau ..... A61G 1/042 296/20
3,057,655 A * 10/1962 Weil ..... A61G 1/0237 296/20
3,088,770 A * 5/1963 Ferneau ..... A61G 1/0262 296/20
3,792,500 A * 2/1974 Swara, Sr. ..... A61G 7/103 5/81.1 R
4,164,355 A 8/1979 Eaton et al.
5,036,557 A 8/1991 Fales
5,178,432 A * 1/1993 Zeman ..... A61G 3/006 280/790
5,933,889 A * 8/1999 Eekhoff ..... A61G 1/0562 248/188.9

(Continued)

OTHER PUBLICATIONS

MobiMedical Stretcher Bed and Ramp, https://medical-stretchers.com/12-mortuary-stretchers, downloaded Jun. 29, 2018.

(Continued)

*Primary Examiner* — William L Miller
(74) *Attorney, Agent, or Firm* — Stiennon & Stiennon

(57) ABSTRACT

A mortuary tray for use within a first call vehicle for removing the body of a decedent from the place of death is adjustable in length to suit various vehicles and may be readily broken down into component parts for economical shipping. A rear part is adjustably received within a front part, and a ramp is hinged to the front part. These three parts may be fabricated of lightweight sheet-metal. The front part has protruding fasteners which extend within parallel slots in the rear part and secured by nuts. The ramp has three segments defined by two folds: a first segment aligns with and extends over the rear opening of a vehicle, a second segment extends over the rear bumper, and a narrow third part is the first which engages a mortuary cot as it enters the vehicle.

10 Claims, 4 Drawing Sheets

(56) References Cited

U.S. PATENT DOCUMENTS

| | | | | |
|---|---|---|---|---|
| 6,681,424 | B1 * | 1/2004 | Bourgraf | A61G 1/0562 5/607 |
| 2004/0080172 | A1 * | 4/2004 | Mitchell | A61G 1/0293 296/20 |
| 2006/0181100 | A1 * | 8/2006 | Lambarth | A61G 1/0262 296/20 |
| 2010/0045059 | A1 * | 2/2010 | Bourgraf | A61G 3/0891 296/19 |
| 2011/0080016 | A1 * | 4/2011 | Lambarth | A61G 3/0236 296/20 |
| 2017/0119601 | A1 * | 5/2017 | Bennett | B60P 7/16 |

OTHER PUBLICATIONS

"Minideck Ramp Systems," Southland Medical LLC http://www.southlandmed.com/category.php?c=SR75, downloaded Jun. 29, 2018.
"Vehicle Ramps," Southland Medical LLC http://www.southlandmed.com/category.php?c=14-05, downloaded Jun. 29, 2018.
Mortuary Cot, http://www.hospital-medicalequipment.com/sale-7662354-corpse-trolley-mortuary-equipment-10001b-multilevel-one-man-control-mortuary-cot.html, downloaded Jun. 29, 2018.
"Single Decksystems," Link Manufacturing, Ltd, Sioux Center, IA (2016).
"Single Deck System (ME): Sealed Fiberglass Minvan & SUV Deck Surface," Southland Medical LLC, http://www.southlandmed.com/category.php?c=SS150, downloaded Jun. 29, 2018.
Southland Medical LLC 2018 Catalog, p. 110, "Vehicle Ramps: Single Deck Systems".
"Removable Cot Tray Standard 28", American Mortuary Coolers & Equipment, https://americanmortuarycoolers.com/collections/first-call-equipment/products/removable-cot-tray-standard-28, downloaded Jul. 3, 2019.

* cited by examiner

MORTUARY TRANSPORT VEHICLE TRAY

CROSS REFERENCES TO RELATED APPLICATIONS

This application claims the benefit of priority of U.S. App. No. 62/694,730, filed Jul. 6, 2018, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to apparatus for transporting the body of a deceased person in a car or van.

Immediately after a person dies several steps must be taken. Generally, first a medical professional or coroner will fill out a pronouncement of death form. Second, the decedent will be transported to a funeral home (mortuary) for preparation of the body for burial or cremation. Although a ceremonial hearse or a special purpose vehicle is used to transport a casket containing the decedent to ceremonial or religious services and then to a burial ground, the first call to the place of death is a quiet matter carried out with discretion with great respect for the bereaved. On these calls a conventional hatchback car, sports utility vehicle (SUV) or van is utilized. Such a vehicle is less costly to operate than a hearse and does not draw attention. The body is strapped to a stretcher which is placed on a mortuary cot which is provided with a collapsible carriage assembly and moved to the vehicle for transporting the body to the funeral home. The mortuary cot has a set of wheels on one end which facilitates rolling the cot into the back of the vehicle. The vehicle is outfitted with a tray or container with a foldable ramp which extends downwardly to the vehicle's bumper and onto which the cot is overlain. To load the cot into the vehicle, the rear hatch or doors are opened and the collapsible cart is moved towards the ramp until the front wheels engage the ramp at which point the cot and supported body are pushed up the ramp and into the vehicle. The undercarriage of the cot collapses as it advances into the vehicle, making the assembly compact enough to be received within the shallow height of a conventional rear deck of the vehicle.

What is needed is an adjustable mortuary transport tray which can be adjusted to fit various vehicles and can be broken down for reduced shipping costs.

SUMMARY OF THE INVENTION

The adjustable dimension mortuary transport vehicle tray of this invention has three main parts. A front part is formed of lightweight sheet-metal, preferably aluminum, for example 11 gauge (⅛ inches thick), and has a rectangular bottom wall with connected front and side lips and an open rear. At least one threaded fastener extends upwardly from the bottom wall and is closely spaced from the front edge. A rear part is similarly formed from, for example, 11 gauge aluminum plate and has two parallel raised side lips which are spaced apart such as to fit within the side lips of the front part. The rear part has a slot extending parallel to the two side lips which fits over the threaded fastener. The rear part has a rear edge opposite the slot which forms one side of a hinge. A ramp part begins with a hinge which is releasably connected to the rear part by a hinge pin. The ramp has two folds such as may be formed in a brake press, the first one arranged to align with and extend over the rear opening of a vehicle. A second fold extends over the rear bumper. The first and second folds divide the ramp into three parts, an opening part, followed by a ramp part, followed by a bumper engagement part which also forms part of the ramp. As installed in the interior of the vehicle the ramp becomes steeper as it extends to the bumper. The three parts of the tray can be separated and stacked to provide compact packaging conforming to, for example, the UPS standard 165 inches in length and girth combined. For example, 48 inches in length plus 2× (width 36 inches plus height 16 inches) totaling 152 inches and a weight of no more than 70 pounds. The tray can also be broken down for compact storage within the vehicle cargo compartment.

It is an object of the present invention to provide a tray for first call removal of human bodies which can be adjusted to fit various vehicle interior dimensions.

It is another object of the present invention to provide a first call removal tray which can be readily broken down into components for economical shipping.

It is a further object of the present invention to provide a first call removal tray which can be broken down for compact storage within a vehicle.

Further objects, features and advantages of the invention will be apparent from the following detailed description when taken in conjunction with the accompanying drawings.

DESCRIPTION OF THE PREFERRED EMBODIMENTS

Figure 1:
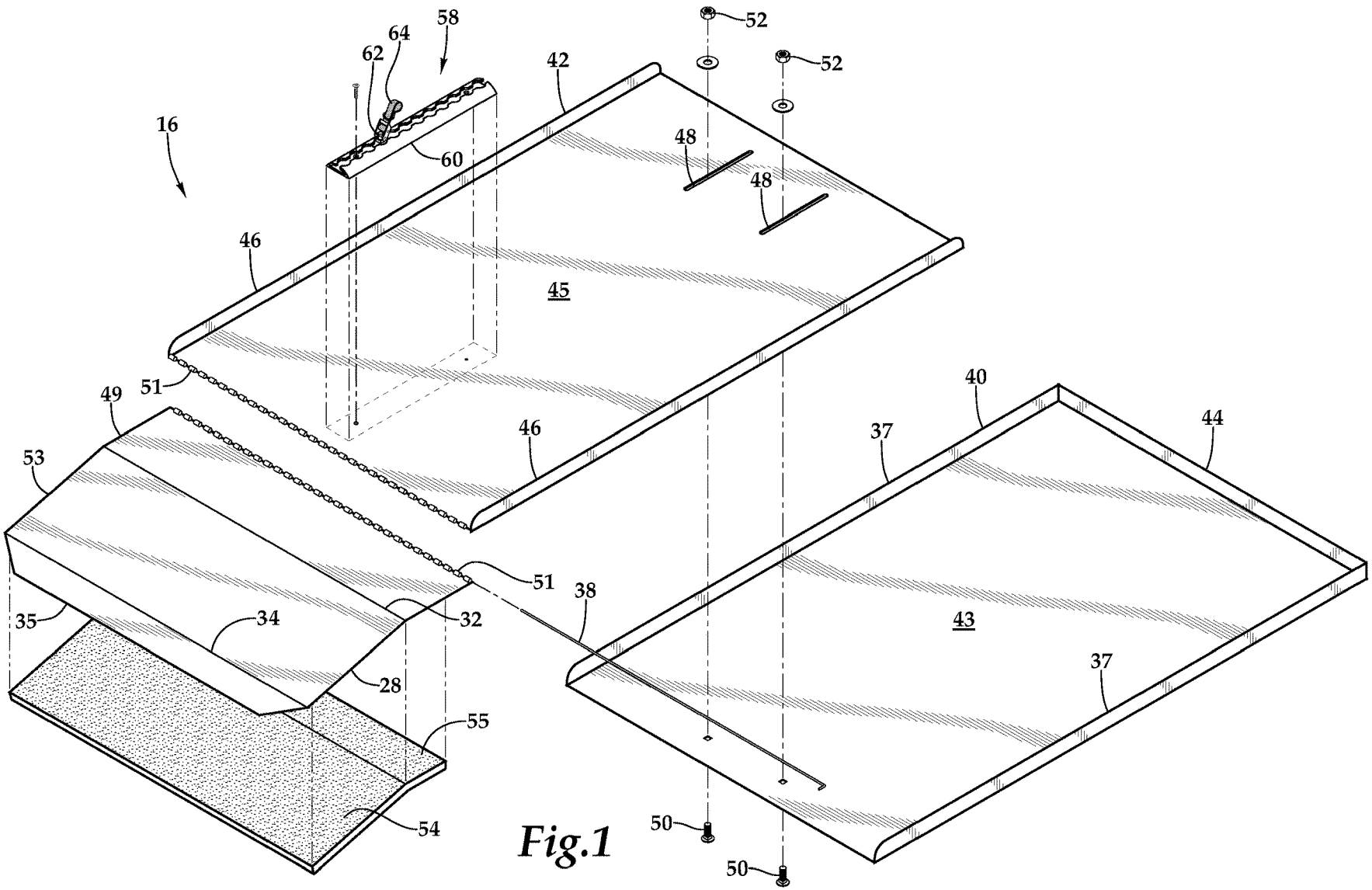
FIG. 1 is an exploded isometric view of an adjustable dimension vehicle tray of this invention.
Figure 2:
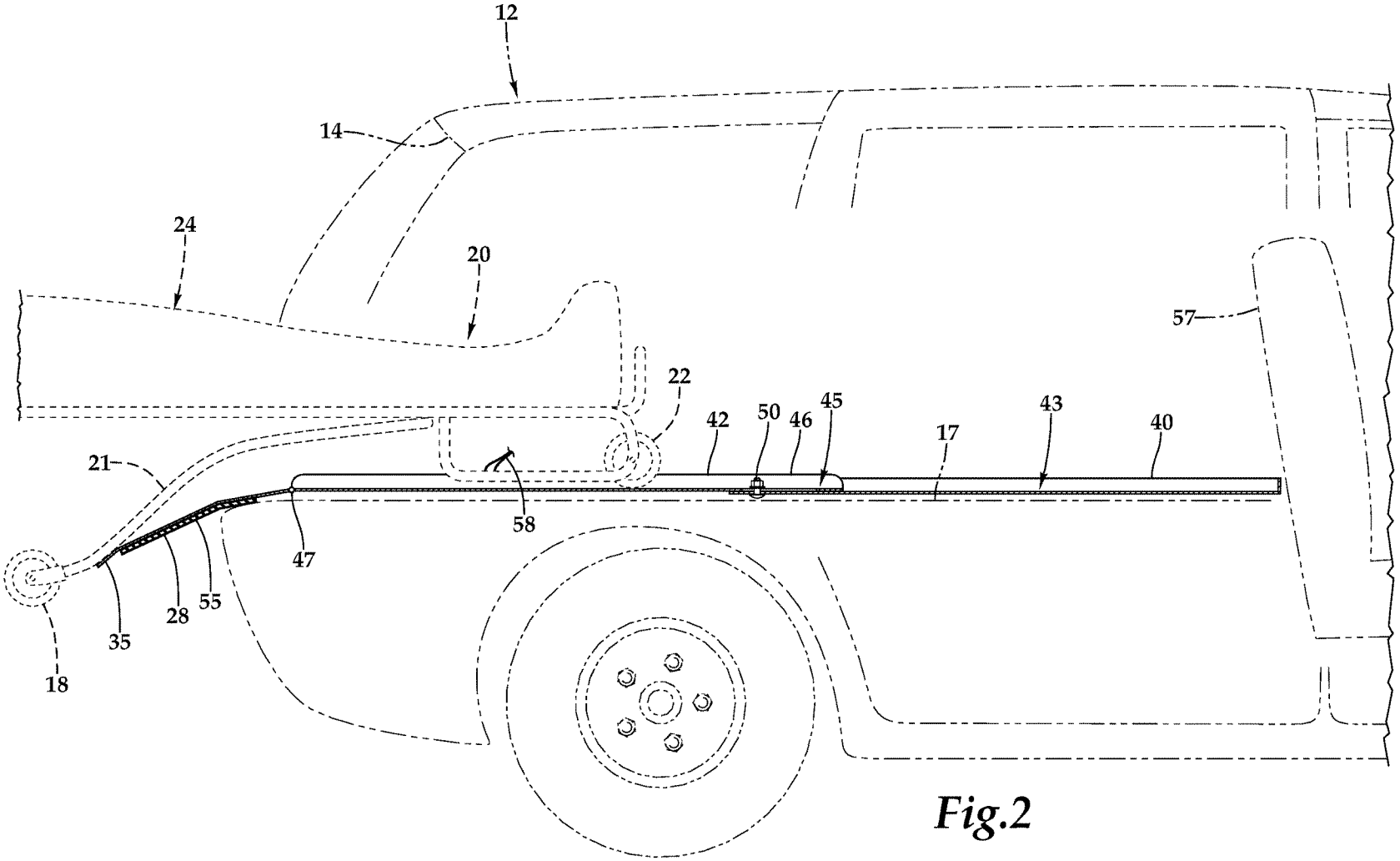
FIG. 2 is a side cross-sectional view of the vehicle tray of FIG. 3, taken along a centerline of the right illustrated tray.

Referring more particularly to FIGS. 1-4 wherein like numbers refer to similar parts, an adjustable dimension vehicle tray 16 of this invention is shown in FIG. 1. The tray 16 is received within the rear deck 17 a vehicle 12, such as a sport utility vehicle (SUV) or hatchback with a rear opening 14. The tray 16 offers protection to the vehicle interior from staining, liquids, etc., from the draped body of a decedent 24 received on a mortuary cot 20. As shown in FIG. 2, the mortuary cot 20, such as the Ferno® morturary cots produced by Ferno-Washington, Inc. of Wilmington, Ohio, has a collapsible undercarriage 21 with legs having wheels 18 including front wheels 22 which are first to enter the vehicle. The cot 20 carries the decedent 24 at a first elevated level, and then is inserted within the vehicle 12 as discussed below.

As shown in FIG. 1, the tray 16 has three parts: a front part 40, a rear part 42 adjustably received in a telescoping relationship within the front part, and a ramp 28 hinged to the rear part. When disassembled, the three parts 40, 42, 28 can be stacked for shipping. These three parts may be fabricated of lightweight sheet-metal, for example 11 gauge (⅛ inch thick) aluminum.

The tray front part 40 has a rectangular bottom wall 43 which has two parallel upwardly extending side lips 37 which are joined by a raised front lip 44. The side and front lips 37, 44 may be welded together, do define a tray margin that prevents liquids escaping into the vehicle. The rear part 42 of the tray 16 has a rectangular bottom wall 45, which is narrower than the front part, and which has two parallel side lips 46. The distance between the two side lips 46 of the tray rear part 42 is thus slightly less than the distance between the side lips 37 of the tray front part 40 such that the rear part 42 and its side lips 46 nest between the front part side lips 37, such that the rear part bottom wall 45 overlaps the front part bottom wall 43 to a greater or lesser extent depending on the desired overall length of the tray 16.

Figure 4:
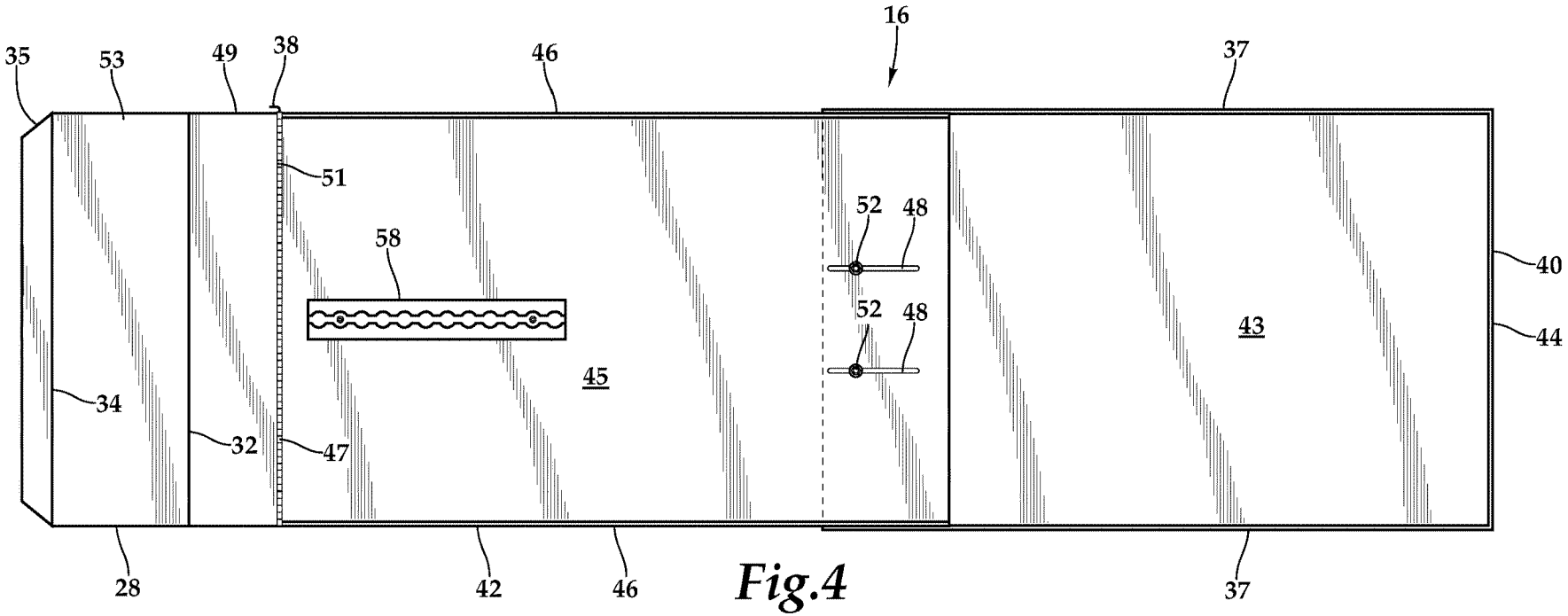
FIG. 4 is a top plan view of the assembled vehicle tray of FIG. 1.

As shown in FIGS. 1 and 4 the tray rear part 42 has two slots 48 which fit over two threaded fasteners 50 which are mounted to the tray front part 40 such that the rear part can be moved over a range of approximately 6 to 18 inches lengthening or shortening the tray 16. After the tray front and rear parts are adjusted to the desired length, the threaded fasteners 50 can be clamped with threaded nuts 52 to releasably lock the front part 40 and rear part 42 together. Wing nuts may alternatively be used where it is desired to permit adjustment without requiring tools. Washers are provided between the nuts and the bottom wall of the tray rear part 45. The threaded fasteners may extend through square holes in the front part 40 which may be, for example, 2 inches from the rear edge of the front part. Alternatively, the threaded fasteners may be welded to the bottom wall 43 of the front part 40. The slots may be 7 inches apart and extend 6⅜ inches rearwardly. Each slot may be 10¼ inch from the rear part side lips 46.

The third part of the tray 16 is a ramp or opening covering part 28, also fabricated of sheet metal and connected to the tray rear part 42 at a hinge 47. The hinge 47 is comprised of interdigitating metal hinge knuckles 51 on the rear part 42 and on the ramp 28 which are releasably connected by a hinge pin 38. The upper surface of the ramp 28 is approximately aligned with the surface of the tray rear part and has two bends which define three segments. The first segment 49 of the ramp part 28 extends from the hinge knuckles 51 to a first fold 32, where the ramp part is bent downward by about 15 to 25° to 30° for example 20° at a first fold 32. The second ramp segment 53 extends from the first fold 32 to a second fold 34, where it is bent a further 10 to 20° for example 15°. A narrow inlet segment 35 extends from the second fold and defines the region of engagement for the incoming front wheels 22 of the mortuary cot 20.

Figure 3:
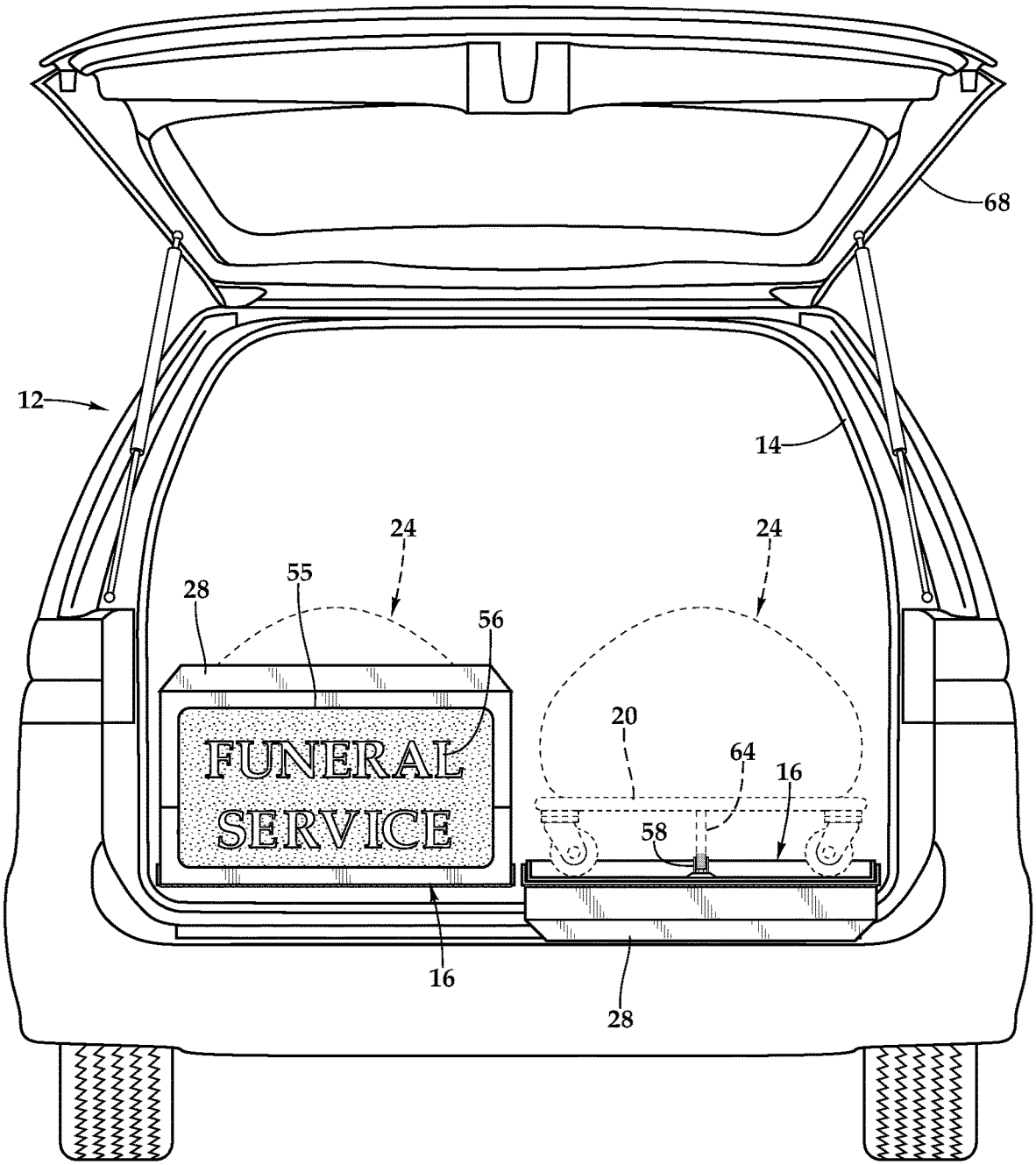
FIG. 3 is a rear view of two side-by-side vehicle trays of this invention installed within a sport utility vehicle with a rear access hatch.

As shown in FIGS. 1, 2 and 3, the ramp part 28 may have an elastomeric sheet 55 adhered by an adhesive 54 to its underside which extends over the first segment 49 and second segment 53, and provides a protective cushion which can shield the bumper from abrasion from contact with the ramp part. Moreover, the elastomeric sheet 55 may have indicia 56 imprinted thereon. The indicia 56 may provide an identifier of the particular funeral home operator who is making the first call.

The tray 16 may be provided with a tie-down arrangement 58 as shown in FIG. 1. The tie-down arrangement 58 has an O-track 60, such as the 12 inch aluminum HD beveled O-track available from Hampton Products International Corp, Foothill Ranch Calif. A strap grip mechanism 62 may be positioned at a desired location on the O-track, and engaged with a connecting strap 64 which is secured to the mortuary cot 20 to thereby restrain the mortuary cot once it is received within the vehicle 12 on the tray 16. Thus even should the center of mass of the decedent-cot assembly shift during transport, the strap grip mechanism and connecting strap can prevent the roll-over of the assembly.

As shown in FIG. 2, when the draped decedent 24 is brought out from the first call on the mortuary cot 20, the cot is brought into engagement with the ramp part 28 of the tray 16 such that the front wheels 22 of the mortuary cot ride up on the ramp part and into the vehicle. The ramp part 28 further protects the vehicle bumper from impact from engagement with the cot, which can reduce the possibility of cracking of the bumper which is oftentimes plastic. The undercarriage 21 is collapsed as the mortuary cot 20 is fully inserted into the vehicle.

The lips 37, 44, 46, of the tray 16 are approximately 1 to 2 inches high and arranged to guide the mortuary cot 20 into the rear opening 14 of the vehicle 12. Once the mortuary cot 20 is entirely within the vehicle 12 the ramp part 28 may be folded up as shown in FIG. 3. When the ramp part 28 is folded upwardly the mortuary cot 20 is constrained between the ramp 28 and the front lip 44 of the front part 40 and the side lips 37 and 46 so that it does not move about while the vehicle 12 is moving. The generally uninterrupted expanse of the combined front part bottom wall 43 and the rear part bottom wall 45 means that the cot can be readily inserted and removed from the tray 16, avoiding the need to raise the tray wheels from, for example, cups recessed in the tray surface.

By adjusting the length of the mortuary cot tray 16 for any particular vehicle, the length can be adjusted such that the mortuary cot tray is held between the rear of one of the front seats 57 as shown in FIG. 2 and the rear door 68 as shown in FIG. 3. If necessary to fit various models of vehicles the rear ramp part 28 can be one of several which can be readily swapped out by removing the hinge pin 38 and replacing the rear ramp with another better suited for a particular vehicle. In this way a single mortuary cot tray can suit multiple vehicles. Two of the trays 16 may be placed side-by-side as shown in FIG. 2, allowing the funeral home operator to make two calls before returning to the mortuary. While a conventional tray may extend nearly the width of the vehicle, the inventive tray is sufficiently wide to support a single mortuary cot, which if desired may result in a significantly more compact and lighter weight tray.

Not only does the multipart arrangement of the tray make it suitable for a wide range of vehicles, but it also allows the tray to be economically shipped to customers using commercial parcel services. The three parts of the tray can be separated and stacked into a knocked down kit to provide compact packaging conforming to, for example, the UPS standard 165 inches in length and girth combined and a weight of no more than 70 pounds. The dimensions of the three parts may be 27⅝ inches by 44⅛ inches by 1¼ inches for the front part 40, and 27⅛ inches by 44 inches by 1⅛ inches for the rear part 42, and 27⅛ inches by 17 inches for the ramp part 28. For example, calculating the compliance with the UPS standard:

Length: 44⅛ inches plus girth=44⅛ inches plus twice the width and height combined, which equals 44⅛ inches plus 2× (27⅛ inches+1¼ inch)=44⅛+2×28⅜=44⅛+56⅝=100⅞ inches, which falls within the UPS package limits.

Not only can the tray 16 be broken down for shipping, it can be collapsed and stored within the vehicle 12, even crosswise, leaving the majority of the SUV load deck available for other cargo. It should be noted that although first call service is an important component of mortuary work, in many cases the vehicle 12 will be used for many other tasks throughout the work day. The ready collapse of the tray 16, or in cases where only a single narrow tray is installed the additional availability of space, makes its use convenient for the many purposes faced by a mortuary vehicle.

It is understood that the invention is not limited to the particular construction and arrangement of parts herein illustrated and described, but embraces all such modified forms thereof as come within the scope of the following claims.

I claim:

1. A mortuary cot transport tray comprising:

a front part having a mortuary cot supporting bottom wall, wherein two parallel side lips extend upwardly from the bottom wall, and a front lip extends upwardly from the bottom wall and between the two parallel side lips;

a rear part having a mortuary cot supporting bottom wall, wherein two parallel side lips extend upwardly from the rear part bottom wall, the rear part being sized such that the two rear part side lips are slidable within the two front part side lips such that the rear part partially nests within the front part;

wherein the front part and rear part are adjustably engageable to form a support surface which is adjustable in length; and a ramp part hingedly connected to the rear part to extend rearwardly therefrom.

2. The mortuary cot transport tray of claim 1 wherein the ramp part has a first part of a hinge, connected by a hinge pin to portions of the rear part which define a second hinge part.

3. The mortuary cot transport tray of claim 1 wherein the ramp part has at least two transverse folds bending downward between 10 and 30 degrees, the folds dividing the ramp part into three segments: a first segment extending from where the ramp part is hingedly connected to the rear part, a second segment extending downwardly from the first segment, and a third segment extending downwardly from the second segment.

4. The mortuary cot transport tray of claim 1 further comprising portions of one of the front part and the rear part which define at least one slot, and at least one fastener extending from the other of the front part and the rear part through said at least one slot, the at least one fastener being selectably securable to fix the front part with the rear part at a desired position to thereby configure the transport tray at a desired length.

5. A mortuary cot transport tray kit arranged for shipping, the kit comprising:

a front part having a mortuary cot supporting bottom wall, wherein two parallel side lips extend upwardly from the bottom wall, and a front lip extends upwardly from the bottom wall and between the two parallel side lips;

a rear part positioned within the front part, the rear part having a mortuary cot supporting rear wall, wherein two parallel side lips extend upwardly from the rear part bottom wall, the two rear part side lips are spaced a distance apart which is less than the spacing of the front part side lips, and the rear part is thus received within the front part;

wherein the rear part has portions of a hinge;

a ramp part having multiple planar segments which are each at an angle 10 to 30 degrees to the segment from which it extends, the ramp part having hinge portions suited to connection to the rear part portions of a hinge;

a hinge pin dimensioned to extend through the ramp part and rear part portions of a hinge; and at least one fastener for adjustably connecting the front part to the rear part, wherein portions of the front part and the rear part are configured to cooperate with the at least one fastener when the kit is assembled to secure the front part and the rear part together in a selected length.

6. The mortuary cot transport tray of claim 5 wherein the ramp part has at least two transverse folds bending downward between 10 and 30 degrees, the folds dividing the ramp part into said multiple planar segments which comprise three segments: a first segment by a hinged connection from the rear part, a second segment extending from the first segment, and a third segment extending from the second segment.

7. The mortuary cot transport tray of claim 5 further comprising portions of one of the front part and the rear part which define at least one slot, and the at least one fastener is configured for extending from the other of the front part and the rear part through said at least one slot, the at least one fastener being selectably securable to fix the front part with the rear part at a desired position to thereby configure the transport tray at a desired length.

8. A mortuary cot transport tray comprising:

a front part having a mortuary cot supporting bottom wall, wherein two parallel side lips extend upwardly from the bottom wall, and a front lip extends upwardly from the bottom wall and between the two parallel side lips;

two threaded fasteners which extend upwardly from the front part bottom wall, the fasteners being at a common distance from the front part front lip;

a rear part having a mortuary cot supporting bottom wall, wherein two parallel side lips extend upwardly from the rear part bottom wall, the rear part being received within the front part in telescoping relation, such that rear part bottom wall overlies the front part bottom wall, and the two rear part side lips are positioned within the two front part side lips, and wherein the front part and rear part are adjustably engageable to form a support surface for a mortuary cot which is adjustable in length;

a nut engaged with each threaded fastener for releasable securement of the rear part to the front part in an arrangement giving a desired length; and a ramp part hingedly connected to the rear part to extend rearwardly therefrom.

9. The mortuary cot transport tray of claim 8 wherein the ramp part has a first part of a hinge, connected by a hinge pin to portions of the rear part which define a second hinge part.

10. The mortuary cot transport tray of claim 8 wherein the ramp part is hingedly connected to the rear part at a hinged connection, and wherein the ramp part has at least two transverse folds bending downward between 10 and 30 degrees, the folds dividing the ramp part into three segments: a first segment extending from the hinged connection to the rear part, a second segment extending downwardly from the first segment, and a third segment extending downwardly from the second segment.

* * * * *